US009702191B2

(12) United States Patent
Mikesell, Sr.

(10) Patent No.: US 9,702,191 B2
(45) Date of Patent: Jul. 11, 2017

(54) STORAGE LADDER

(71) Applicant: Andrew Mikesell, Sr., Indianapolis, IN (US)

(72) Inventor: Andrew Mikesell, Sr., Indianapolis, IN (US)

( * ) Notice: Subject to any disclaimer, the term of this patent is extended or adjusted under 35 U.S.C. 154(b) by 8 days.

(21) Appl. No.: 13/761,494

(22) Filed: Feb. 7, 2013

(65) Prior Publication Data

US 2014/0216851 A1 Aug. 7, 2014

(51) Int. Cl.
*E04G 1/00* (2006.01)
*E06C 7/14* (2006.01)

(52) U.S. Cl.
CPC ..... *E06C 7/14* (2013.01)

(58) Field of Classification Search
CPC ..... E06C 7/08; E06C 7/07; E06C 7/14; E06C 7/143
USPC ..... 182/129, 164, 194; 206/372, 373; 248/210, 211, 238
See application file for complete search history.

(56) References Cited

U.S. PATENT DOCUMENTS 1,514,885 A * 11/1924 Bigler ..... B25H 5/00 190/19
2,942,830 A * 6/1960 Senay ..... E06C 7/14 248/201
3,313,507 A * 4/1967 Belli ..... B44D 3/14 248/211
3,642,240 A 2/1972 Hershey
3,842,936 A 10/1974 DeLuca
3,871,481 A * 3/1975 Ballek ..... E06C 1/38 182/151
3,976,163 A * 8/1976 Watkinson ..... 182/20
3,997,027 A * 12/1976 Patterson ..... E06C 1/38 182/195
4,077,595 A * 3/1978 Carter et al. ..... 248/210
4,586,615 A * 5/1986 Quitmann ..... B65D 73/0007 206/349
4,613,042 A * 9/1986 Aeschliman ..... 206/419
4,714,162 A * 12/1987 Harrison ..... 206/419
4,964,601 A * 10/1990 Dishman ..... 248/210
5,005,710 A * 4/1991 Hofer ..... B25H 3/04 206/373
5,181,682 A 1/1993 Indelicato
5,191,954 A 3/1993 Ledford
5,236,161 A * 8/1993 Haven ..... 248/210
5,419,409 A * 5/1995 Corulla ..... 182/129
5,505,302 A 4/1996 Ferley
5,542,535 A * 8/1996 Dalton ..... 206/419
5,547,080 A 8/1996 Klimas (Continued)

FOREIGN PATENT DOCUMENTS

DE 19920671 A1 11/2000
GB 2276191 A 9/1994

*Primary Examiner* — Jerry Redman
(74) *Attorney, Agent, or Firm* — Woodard, Emhardt, Moriarty, McNett & Henry LLP

(57) ABSTRACT

The present invention relates to a ladder with a design such that storage is incorporated into the ladder body, most notably the rails, by providing for a storage area for tools and other things, which will be incorporated into the manufacture of the ladder. An alternative version is a storage unit approximately the width of the rails of existing ladders, which can be fixedly attached thereto, providing a storage area for tools and other things.

11 Claims, 5 Drawing Sheets

(56) References Cited

U.S. PATENT DOCUMENTS

| | | | | | |
|---|---|---|---|---|---|
| D374,937 | S | * | 10/1996 | Salas | B25H 3/04 D25/68 |
| 5,584,357 | A | * | 12/1996 | Gugel | B25H 3/06 182/129 |
| 5,603,405 | A | | 2/1997 | Smith | |
| 5,613,574 | A | | 3/1997 | Melanson | |
| 5,950,762 | A | * | 9/1999 | George | 182/129 |
| 5,971,102 | A | * | 10/1999 | Brown | 182/129 |
| 5,984,046 | A | * | 11/1999 | Urso, Jr. | 182/129 |
| 6,269,907 | B1 | | 8/2001 | Gillespie | |
| 6,352,135 | B1 | | 3/2002 | Jones | |
| 6,357,706 | B1 | * | 3/2002 | Fleckenstein | 248/210 |
| 6,467,577 | B1 | * | 10/2002 | Charlebois, Jr. | 182/129 |
| 6,502,664 | B1 | * | 1/2003 | Peaker, Sr. | 182/129 |
| 6,536,590 | B1 | | 3/2003 | Godshaw et al. | |
| 6,824,115 | B1 | * | 11/2004 | Batson | 248/238 |
| 7,017,598 | B2 | * | 3/2006 | Nipke | A45B 3/00 135/16 |
| 7,174,994 | B1 | * | 2/2007 | Coffield et al. | 182/129 |
| 8,136,774 | B2 | * | 3/2012 | Melittas | 248/210 |
| 8,162,275 | B2 | * | 4/2012 | Reusser | 248/210 |
| 8,616,912 | B1 | * | 12/2013 | Vendura | E06C 7/00 439/368 |
| 2004/0140409 | A1 | | 7/2004 | Radda | |
| 2005/0061584 | A1 | * | 3/2005 | Louthen | 182/129 |
| 2005/0092550 | A1 | * | 5/2005 | Lanzafame | 182/200 |
| 2005/0224287 | A1 | * | 10/2005 | LaBrash | E06C 1/34 182/84 |
| 2005/0269156 | A1 | * | 12/2005 | Lanzafame | E06C 1/34 182/129 |
| 2006/0131106 | A1 | | 6/2006 | Adams | |
| 2006/0163003 | A1 | | 7/2006 | Wigstrom | |
| 2007/0056999 | A1 | * | 3/2007 | Kahn | A45F 5/02 224/250 |
| 2007/0221802 | A1 | | 9/2007 | New, Sr. | |
| 2007/0228237 | A1 | | 10/2007 | Pochurek | |
| 2008/0035426 | A1 | | 2/2008 | Leuthner | |
| 2009/0026155 | A1 | * | 1/2009 | Bernard | 211/70.6 |
| 2009/0152047 | A1 | * | 6/2009 | McLain | 182/129 |
| 2011/0079467 | A1 | | 4/2011 | Mares | |
| 2011/0232999 | A1 | * | 9/2011 | Lanzafame | 182/194 |
| 2013/0192924 | A1 | * | 8/2013 | Paun | 182/129 |

* cited by examiner

STORAGE LADDER

FIELD OF THE DISCLOSURE

This invention relates to a new design for a ladder that incorporates the ability to store things, including tools, for use by those individuals using the ladder. The present invention is a ladder that takes advantage of the space created by a new design for the ladder uprights (which are called stringers or rails) to enable the storage of items within the ladder, without significantly increasing the amount of space used by the ladder or its weight.

Historically ladders are made up of steps or rungs (for purposes of this application the term "step(s)" will be used throughout), which are attached to vertical elements that are called stringers or rails (for purposes of this application, the term "rail(s)" will be used). The rails are on each end of the steps and provide the ability for weight to be placed on the steps without displacement.

There are generally two kinds of ladders today, stepladders, which are designed to stand on their own, and extension ladders, which are meant to be used by leaning them against something (and of which have no ability to stand on their own). In addition to steps and rails, there are also additional elements that might be seen, such as spreaders in a stepladder, which are the metal bars that include hinges that connect the front and rear rails. Another element also commonly seen on stepladders is a shelf. On extension style ladders you will also see extension locks, which are the locks or hooks that securely hold the two parts of the ladder together at the desired height.

Ladders have been used for thousands of years and Henry Quackenbush even patented the first extension ladder in 1867. The obvious deficiency with the traditional design of ladders is that they provide no means in which to store tools within the confines of the structure of the ladder, to be used by those employing the ladder. This is particularly vexing when you consider that rarely does someone take a journey onto a ladder for the singular reason of checking out the view. Normally there is work to be done and most times this work involves the use of various tools or supplies.

Numerous types of ladders have been provided in the prior art in an attempt to address the issue of storing tools or supplies. For example, U.S. Pat. No. 5,971,102 (Brown); U.S. Pat. No. 5,505,302 (Ferley); U.S. Pat. No. 5,547,080 (Klimas); U.S. Pat. No. 5,603,405 (Smith) and U.S. Pat. No. 5,613,574 (Melanson) are all illustrative, however these inventions are not as suitable for the purposes of the present invention, described herein.

SUMMARY OF THE INVENTION

The present invention relates to a storage ladder that allows a user access to tools and supplies without the need to leave the ladder. These tools and supplies would also be securely maintained such that the ladder could be moved around without the necessity of removing the tools and/or supplies. This is accomplished by a new design of the rails, which are attached to the steps. This design creates a space that is reachable by the user and can hold tools and supplies. Traditionally, rails have been designed in one of two ways, either as two rails on each side, such as a left-front and left-rear and a right-front and right-rear, while the more common modern design is an integrated rail which wraps slightly around each step toward the middle of the step. This design is meant to take advantage of a box-like cross-section for the rails that provides additional strength and stability.

In the present invention the rails are designed such that the steps are attached to the rails on the ends, with the box-like design being outside the rails versus wrapping around the steps. While this still provides the strength and stability of the common modern design, it more importantly, creates a space, or storage area, in which to store items such as tools and/or supplies (hereinafter collectively "tools"). The design could also be incorporated into the traditional design for additional strength, such that there is a box-like cross-section inside and outside the rails, which would provide even greater strength and stability. Another variation involves using a removable box that can be slipped inside the storage area and held in place by any number of known means. This removable box can then be used to hold the tools and/or supplies but can also removed and replaced with a second removable box which could be suited for different kinds of tools. This removable box would increase the flexibility and use of the storage ladder. Further incorporated into the storage area, either with or without the removable box, would be a means to fixedly hold the tools such that that ladder could be transported without the necessity to remove the tools. There would also be the option to provide for a door or cover of the storage area to maintain a clean appearance, assist with holding the tools in place and to further provide additional rigidity to the structure. Further, due to the increased weight from the tools, an additional option would wheels or casters that can be incorporated into or fixedly attached to the ladder to facilitate ease of transport.

BRIEF DESCRIPTION OF THE DRAWING(S)

DESCRIPTION

For the purpose of promoting an understanding of the principles of the present invention, reference will now be made to the embodiment illustrated in specific language contained herein. It will, nevertheless, be understood that no limitation of the scope of the invention is thereby intended; any alterations and further modifications of the described or illustrated embodiments, and any further applications of the principles of the invention as illustrated therein are contemplated as would normally occur to one skilled in the art to which the invention relates.

Figure 4:
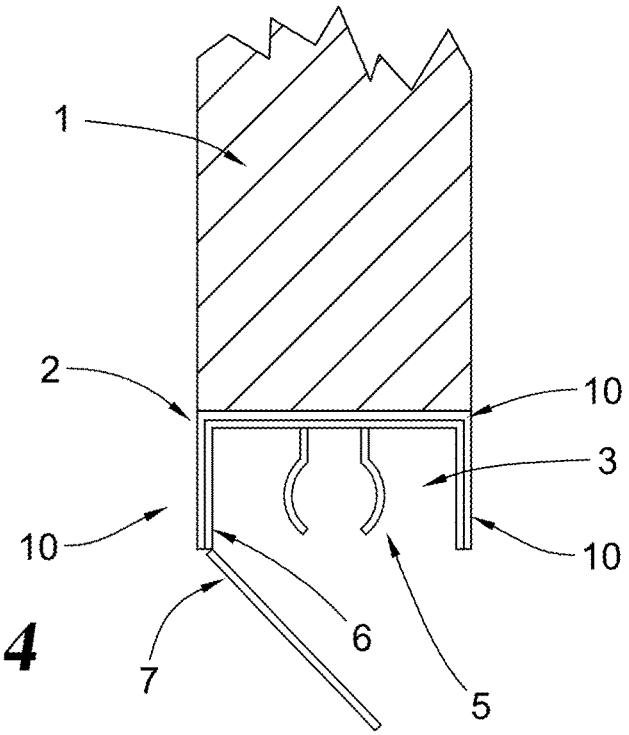
FIG. 4 shows a top view of the cross-section of one end of the rail showing the step attached thereto with a storage area insert.

One form of the present invention is a storage ladder whereby the rails, which form the vertical elements of a ladder are of a U shape with the open part of the U pointing outward from the steps. The steps 1 are attached to the inside portion of two rails 2, which are running parallel, as seen in the Figures. This new design for the rails creates an open space 3 which can be used to store tools and other equipment. This rail would be of sufficient width and depth to facilitate the storage of common tools 4, such as hammers, wrenches, screwdrivers but not of a width or depth which would make grabbing or holding the rail (such as when the ladder was being moved or someone was climbing the ladder) difficult or troublesome. An attachment means 5 would also be included within the rails to fixedly hold the tools in place when they are not being used. Another potential option with regard to holding tools, could be a small rectangular removable box 6 as shown in FIG. 4, which can then placed between the newly designed rails, being just slightly smaller than the width of the rail, to facilitate a snug fit, and held in place with clips or rivets. There is also the possibility to incorporate small trays or containers for tools or pieces which are small or numerous. Another potential element of the present invention would be a door or cover 7, as seen in FIG. 4, that would enclose the storage area and could, optionally, be locked. This will help maintain a clean look for the ladder and will further prevent theft of the tools contained therein. Alternatively, the cover could be clear to facilitate viewing of the tools and equipment contained therein. Another potential element of the present invention would be the means to move the ladder without lifting it of the ground. This would be accomplished by incorporating into the manufacturer or attaching thereafter, wheels or casters onto two or more of the end of the rails that are nearest the ground. The wheels or casters would be such that they could be moved out of the way, when not needed.

Figure 1:
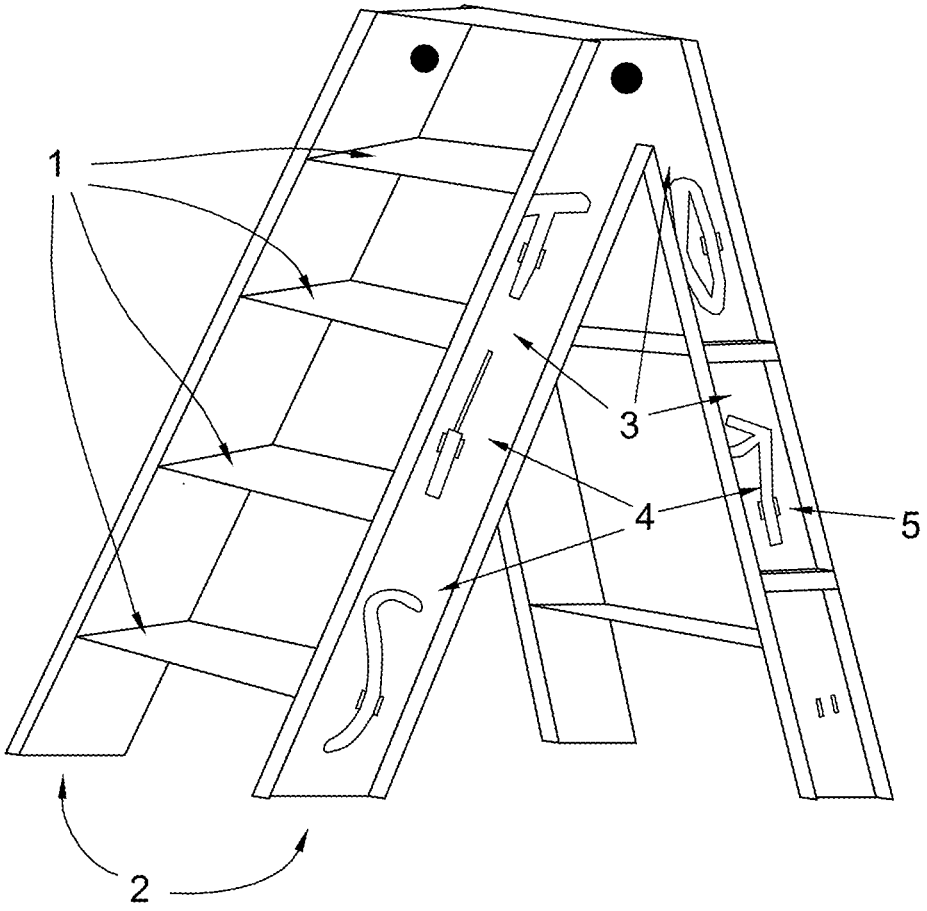
FIG. 1, shows a drawing of the storage ladder in three-dimensional view with tools affixed thereto.
Figure 2:
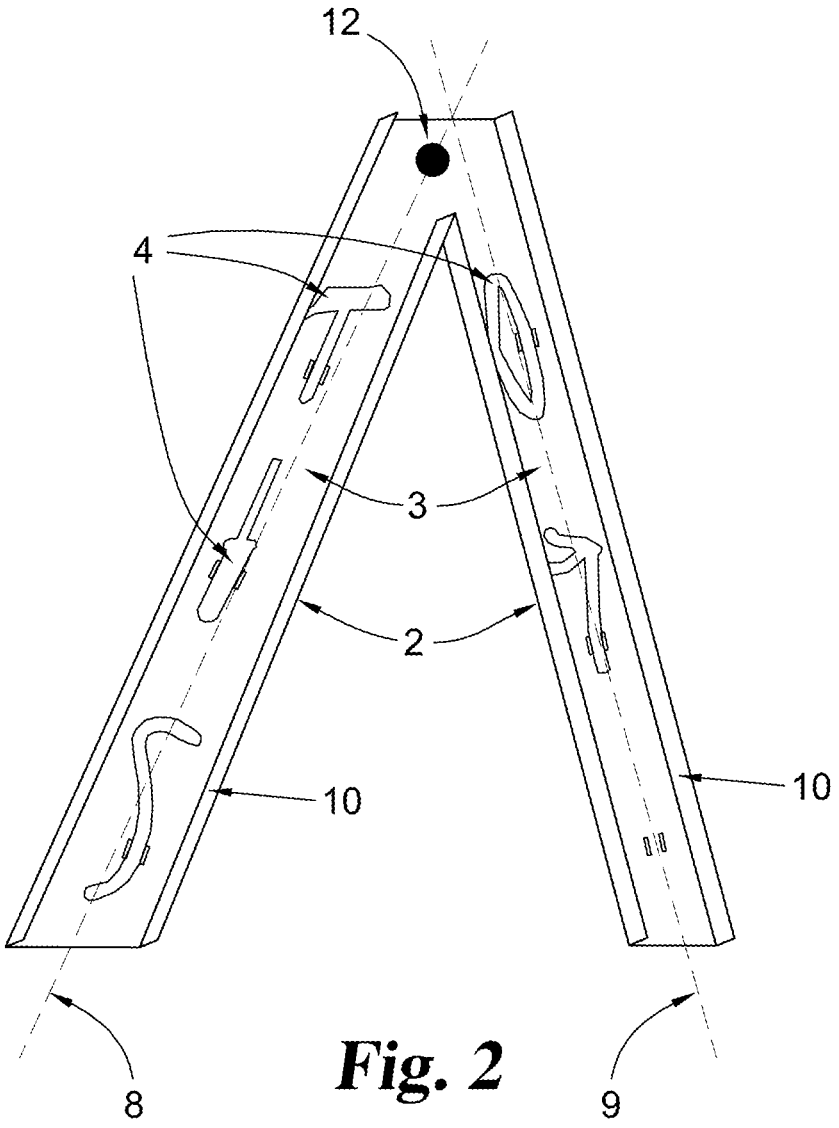
FIG. 2, shows a drawing of one version of the storage ladder from a side view with tools being held in the storage area.
Figure 3:
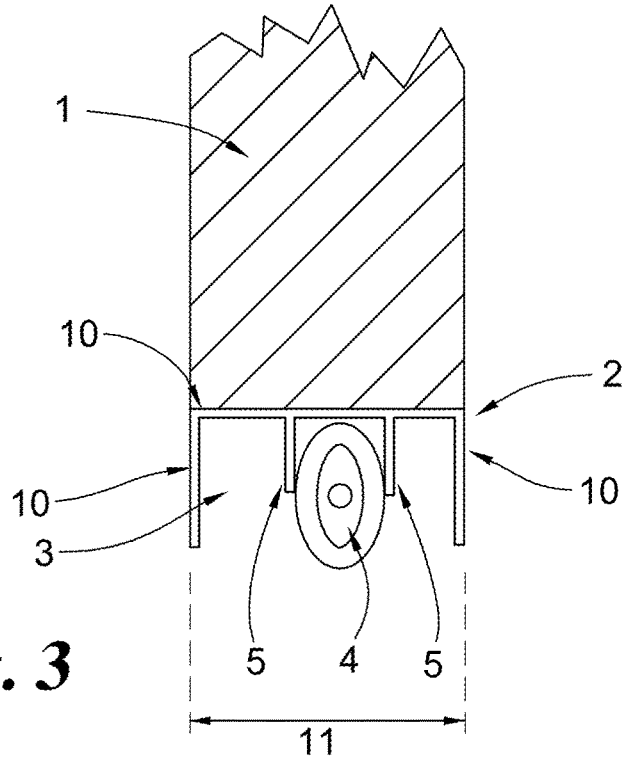
FIG. 3 shows a side, top and front view of one version of the storage ladder.

FIG. 2 illustrates a side view of the ladder of FIG. 1. The side view illustrates a first longitudinal axis 8 of a rail 2 and a second longitudinal axis 9 of a second rail. The rails are illustrates as being rotatably coupled 12 near the longitudinal ends of the rails to form a "V"configuration. FIG. 3 illustrates a top view of a rail of the ladder. The top view includes the exterior walls 10 of the rail 2. The exterior walls, as illustrated, form a "U" shape with the opening 11 of the "U" shape substantially facing the same direction (the direction illustrated being towards the viewer). If the step is attached to two separate rails on both ends, as is illustrated in FIG. 1, the opening 11 of the "U" shape also faces away from the other rail. FIG. 3 also illustrates a tool attachment device 5 attached to the rail 3, the tool attachment device configured for holding a tool 4. The tool attachment device 5 is illustrated as holding the tool by gripping it on opposing sides.

An additional variation of the invention, as applied to step-ladders, would be to not only have storage capability along the rails which incorporate the steps, but also on the second set of rails, which are the rails that do not include steps and are generally held together with cross-bracing or other supports, and connect with the first set of rails at the top, which creates the ability of the ladder to stand on its own.

Often when someone is employing the use of a ladder it is because there is a need to fix or repair something that is only accessible via a ladder. Traditionally, someone tasked with such a repair would employ the use of a tool-belt or toolbox in which to carry the necessary tools or supplies. The obvious shortcomings with this method is that you would be required to carry more than just the ladder, thus causing additional effort and time in which to make the repair. There is also the possibility of theft of tools or equipment. For example, if one would need to carry a ladder to a location of repair, thus leaving behind tools and equipment, these could be the subject of a theft. A more efficient means would be if only one trip were necessary based upon the fact the ladder incorporated a means to store the tools and equipment. In this way, one would only need to load the ladder with the tools and equipment needed for the job, and then could carry the ladder, along with the tools and equipment, as one unit. Additionally, unlike a tool box, having storage in the ladder means the tools and equipment are within easy reach of the user versus having to go down the ladder to retrieve the necessary equipment. This increases the speed in which the job can be completed and also increases safety by eliminating unnecessary trips up and down a ladder.

A second version of this invention would incorporate two U shaped elements on the rails, back to back, so that each rail, in cross-view, would resemble an I beam. On one side of the rail, the steps would be attached to the first U-shaped section, wrapping slightly around the steps. The second U-shaped section would provide the storage area as described in the first version of the invention. This same area could also be used to put the removable rectangular boxes disclosed in the first version of the invention.

An additional version of this invention could also include a means to plug in electric tools by incorporating into the storage area an electrical outlet or strip. This outlet or strip would be connected to an electrical power source via a cord that is incorporated into the rails and exits such near the bottom thereof. An additional element could be a means for attaching a personal electronic device (phone, Ipod® portable music player, mp3 player, etc.), with or without external speakers, such that the device and/or speakers are included within the storage area or attached externally to the ladder.

Figure 5:
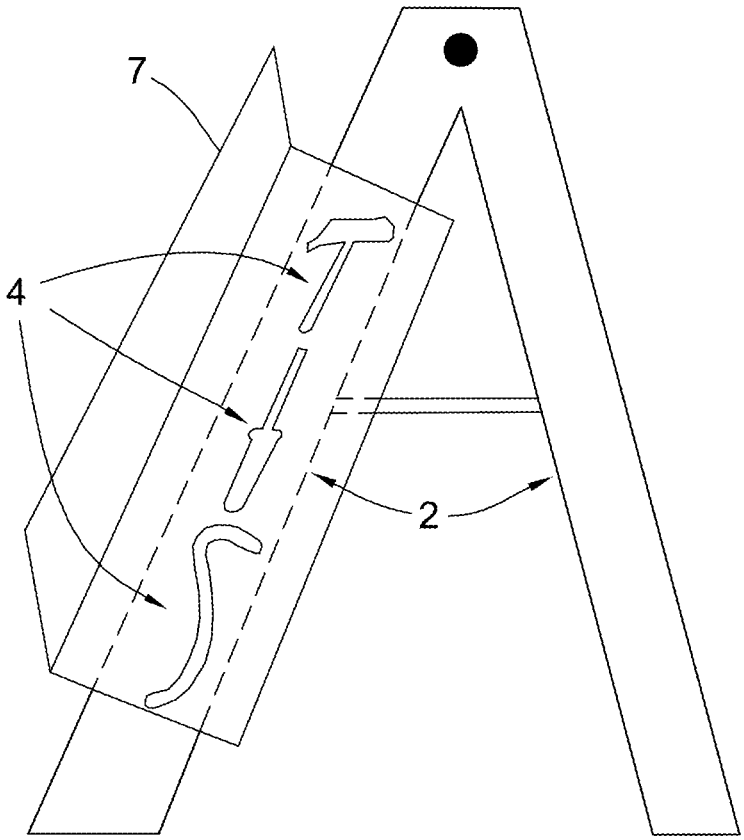
FIG. 5, shows a drawing of one version of the retrofit version of the storage ladder, from a side view, with tools being held in the storage area and a cover.
Figure 6:
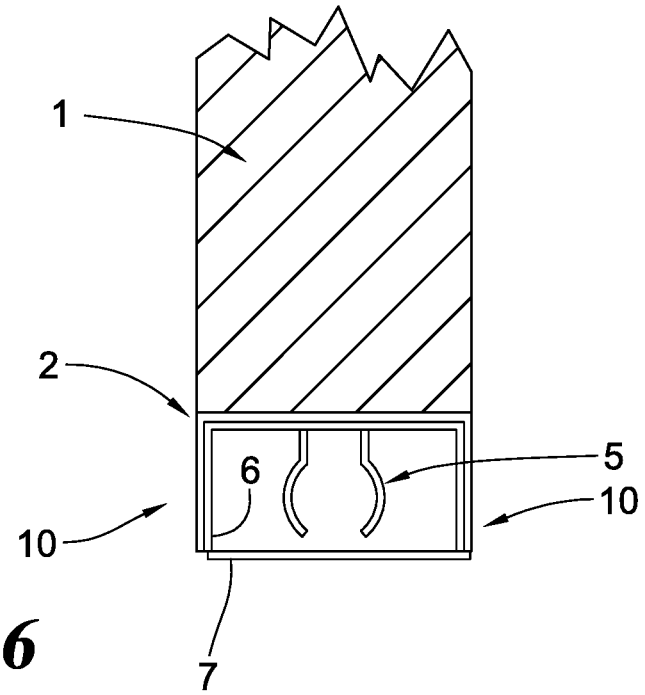
FIG. 6, shows another top view of the cross-section of one end of the rail, similar to FIG. 4, but the door to the storage area being closed and locked.

While this invention would be most effective if incorporated into the initial manufacturing process for a ladder, it is possible that such a storage unit can be incorporated into existing ladders as shown in FIG. 5, by simply attaching the U-shaped storage to the existing rails for a ladder. In this case, the size of the storage unit can mimic the width of the rail but it can also be slightly larger, as shown in FIG. 5. Furthermore, a U-shaped storage channel can also be attached, which would then accept the removable rectangular storage units within the channel, as described in the first version of this invention. Additionally, while this invention would prove most helpful for professionals in the trades (plumbing, electrical, painting, carpentry) there would be similar benefits seen by homeowners or other casual users of the invention.

While the invention has been illustrated and described in detail with the foregoing description, the same is to be considered as illustrative and not restrictive in character, it being understood that while the preferred embodiment has been described, that all changes and modifications that come within the spirit of the invention are desired to be protected.

What is claimed is:

1. A storage ladder, comprising:

a first rail;

a second rail having an interior surface and a pair of sidewalls extending from opposite ends of the interior surface and away from said first rail, wherein the pair of sidewalls extend further outward from said interior surface in the direction away from said first rail than the pair of sidewalls extend inward in the direction toward said first rail such that the interior surface and the pair of sidewalls define a storage recess within said second rail on the side of said interior surface which is opposite of said first rail, wherein the second rail further comprises a door connected to the pair of sidewalls at the ends of the sidewalls opposite from the first rail such that the storage recess is accessible by opening the door;

a plurality of parallel steps fixedly attached to the first rail and the interior surface of said second rail;

a tool attachment device secured to the interior surface of said second rail or one of said sidewalls and wholly contained within the storage recess, wherein the tool attachment device is configured to removably hold a tool within the storage recess.

2. The storage ladder of claim 1, wherein at least a portion of the surface of the door is formed from a transparent material.

3. The storage ladder of claim 1, wherein the second rail has a "U" shaped cross-sectional profile formed by the interior surface and the pair of sidewalls.

4. The storage ladder of claim 1, wherein the second rail has a boxed cross-sectional profile formed by the interior surface, the pair of sidewalls and the exterior surface.

5. The storage ladder of claim 1, wherein said tool attaching device comprises a clamp.

6. The storage ladder of claim 1, further comprising a third rail and a fourth rail each having a longitudinal axis, wherein the first rail is rotatably coupled at one end to the third rail and the second rail is rotatably coupled at one end to the fourth rail such that the ladder can form a V configuration.

7. The storage ladder of claim 1, wherein the first rail has a first interior surface and a first pair of sidewalls extending from opposite ends of the first interior surface and away from the second rail, wherein the first interior surface and the first pair of sidewalls define a second storage recess within said second rail and wherein a plurality of tool attachment devices are secured to the first interior surface of said first rail, wherein the plurality of tool attachment devices are each configured to removably hold a tool within said second storage recess.

8. The storage ladder of claim 1, wherein a plurality of tool attachment devices are secured to the interior surface of said second rail and wholly contained within the storage recess, wherein the plurality of tool attachment devices are each configured to removably hold a tool within the storage recess.

9. The storage ladder of claim 1, wherein at least one of the parallel steps does not extend beyond the interior surface in a direction away from the first rail.

10. A storage ladder with a removable container, comprising:

a first rail;

a second rail having an interior surface and a pair of sidewalls extending from opposite ends of the interior surface only in the direction away from said first rail, wherein the interior surface and the pair of sidewalls define a storage recess within said second rail and wherein the second rail further comprises a door connected to the pair of sidewalls at the ends of the sidewalls opposite from the first rail such that the storage recess is accessible by opening the door;

a plurality of parallel steps fixedly attached to the first rail and the interior surface of said second rail;

a storage container sized to fit securely within at least a portion of the storage recess, wherein the storage container is configured to enable removable coupling of the storage container to the interior of the storage recess.

11. The storage ladder of claim 10, further comprising:

a tool attachment device configured to removably hold a tool;

wherein the tool attachment device is attached to the interior of the storage container.

* * * * *